United States Patent [19]

Losee

[11] Patent Number: 4,839,661

[45] Date of Patent: Jun. 13, 1989

[54] GUIDED WAVE ANTENNA SYSTEM AND METHOD

[75] Inventor: Ferril A. Losee, Provo, Utah

[73] Assignee: Eyring Research Institute, Inc., Provo, Utah

[21] Appl. No.: 700,934

[22] Filed: Oct. 9, 1984

Related U.S. Application Data

[63] Continuation-in-part of Ser. No. 393,043, Jun. 23, 1982, which is a continuation-in-part of Ser. No. 308,080, Oct. 2, 1981.

[51] Int. Cl.[4] ..... H01Q 1/04

[52] U.S. Cl. ..... 343/719; 343/847

[58] Field of Search ..... 343/719, 724, 794, 813, 343/847, 877, 854

[56] References Cited

U.S. PATENT DOCUMENTS

| | | | |
|---|---|---|---|
| 1,387,736 | 8/1921 | Rogers . | |
| 1,424,365 | 8/1922 | Loftin et al. . | |
| 1,429,240 | 9/1922 | Hanson et al. . | |
| 1,530,129 | 3/1925 | Loftin et al. . | |
| 1,894,244 | 1/1933 | Ruble . | |
| 2,161,044 | 6/1939 | Heintz et al. | 173/367 |
| 2,225,668 | 12/1940 | Subkow et al. | 177/352 |
| 2,574,733 | 11/1951 | Ehrlich | 250/33 |
| 2,834,012 | 5/1958 | Allen | 343/723 |
| 2,842,768 | 7/1958 | Halperin | 343/877 |
| 2,989,621 | 6/1961 | Barton et al. | 250/4 |
| 2,992,325 | 7/1961 | Lehan | 250/3 |
| 2,998,516 | 8/1961 | Lehan et al. | 250/5 |
| 3,183,510 | 5/1965 | Rawls | 343/719 |
| 3,215,937 | 11/1965 | Tanner | 325/28 |
| 3,346,864 | 10/1967 | Harmon | 343/719 |
| 3,400,402 | 9/1968 | Gallagher et al. | 343/723 |
| 3,577,148 | 5/1971 | Holzschuh | 343/821 |
| 3,594,798 | 7/1971 | Leydorf et al. | 343/719 |
| 3,775,772 | 11/1973 | Carrell | 343/719 |
| 3,803,616 | 4/1974 | Kopf et al. | 343/719 |
| 3,867,710 | 2/1975 | Busignies | 340/4 R |
| 3,967,201 | 6/1976 | Rorden | 325/28 |
| 4,511,898 | 4/1985 | Bush | 343/736 |
| 4,687,445 | 8/1987 | Williams | 343/719 |

OTHER PUBLICATIONS

The Radio Amateur's Handbook, American Radio Relay League, Fiftieth Ed., 1973, pp. 578–581, P.T.O. Scientific Library.

King, Ronald W. P., "The Theory of Linear Antennas with Charts and Tables for Practical Applications", pp. 436, 579–597 (1956).

"Antenna Engineering Handbook", Edited by Henry Jasik, pp. 215–224 (1961).

(List continued on next page.)

*Primary Examiner*—Theodore M. Blum

*Attorney, Agent, or Firm*—Workman Nydegger Jensen

[57] ABSTRACT

A novel underground guided wave antenna system and method. The system comprises at least one substantially linear, electrically insulated radiating element which is buried in the earth so as to lie no more than approximately one skin depth below the earth's surface. The effective electrical length of each radiating element is equal to at least one-third of the wavelength, as measured in the earth, of the electromagnetic signals being propagated; and the effective electrical length of a radiating element may be made greater than its actual physical length, if desired, by providing tree terminations at the ends of such radiating element.

The efficiency of the system can be increased, particularly when operating at high frequencies, by surrounding the radiating elements with a low loss dielectric substance, such as, for example, crushed rock. Preferably, such dielectric substance is configured such that at least a portion of each radiating element adjacent at least one end thereof lies substantially adjacent the earth, while the remaining portions of each radiating element lies substantially adjacent the dielectric substance. In addition, the gain of the system can be significantly increased, while maintaining substantially the same radiation pattern, by forming an underground array comprising a plurality of the above-described radiating elements which are positioned substantially parallel to one another. Significantly, the distance between adjacent radiating elements in such an array can be as small as one-half of the skin depth in the earth of the electromagnetic signals being propagated.

78 Claims, 5 Drawing Sheets

OTHER PUBLICATIONS

Guy, A. W. & Hasserjian, G., "Underground Antenna Systems Design Handbook", The Boeing Company Report No. D2-7760 (Nov. 1961) also known as Design Criteria for Buried Antennas (produced under Minuteman Contract No. AF 04(647)-289.

Hasserjian, G. & Guy, A. W., "Low-Frequency Subsurface Antennas", IEEE Transactions on Antennas and Propagation, pp. 225-232 (May, 1963).

Guy, A. W. & Hasserjian, G., "Impedance Properties of Large Subsurface Antenna Arrays", IEEE Tranactions on Antennas and Progagation, pp. 232-240 (May 1963).

Wundt, R., Buried "Traveling-Wave Antennas", Applied Research Laboratory, Sylvania Electronic Systems, Research Report No. 394 (Mar., 1964).

Wolff, Edward A., "Antenna Analysis", pp. 241-267 (1966).

Blake, LaMont V., "Antennas", pp. 209-255 (1966).

Christinsin, Alan S., "More on the Long Haul Inverted L Long Wire", (1976).

Christinsin, Alan S., "The AFWONXX Longwire", (1976).

Christinsin, Alan S., "More on the AFWONXX Sloping Long Wire", (1976).

Christinsin, Alan S., "Theoretical Performance Comparison of Two Tactical Long Wire Type Antennas Over Poor Ground", (1976).

Misek, Victor A., "The Beverage Antenna Handbook", First Edition (1977).

"Antenna Engineering Handbook, Second Edition", edited by Richard C. Johnson and Henry Jasik, pp. 11-18 (1961-1984).

Drumeller, Carl C., "Travelling-Wave Antennas", CQ Magazine, p. 32 (Apr., 1984).

Blake, LaMont V., "Antennas", pp. 209-255 (1984).

Smith, Glenn S., "Annotated Bibliography on Buried Antennas", Georgia Institute of Technology, School of Electrical Engineering, (Feb., 1986) (produced under Government Contract No. F30602 81-C-0185).

"Notes: Wireless Telegraphy With Invisible Antennae", *The Electrician,* No. 1,764, p. 1 (Mar. 8, 1912, Great Britain).

Kiebitz, "Recent Experiments on Directive Wireless Telegraphy With Earth Antennae", *The Electrician,* No. 1,764, pp. 868-870 (Mar. 8, 1912, Great Britain).

The American Radio Relay League, Inc., *The A.R.R.L. Antenna Book,* pp. 236-237 (1960, U.S.A.).

Biggs et al., "Radiation Fields of an Inclined Electric Dipole Immersed in a Semi-Infinite Conducting Medium", *IEEE Transactions on Antennas and Propagation,* pp. 306-310 (May, 1963).

Blair, "Experimental Verification of Dipole Radiation in a Conducting Half-Space", *IEEE Transactions on Antennas and Propagation,* pp. 269-275 (May, 1963).

Chen, "The Small Bare Loop Antenna Immersed in a Dissipative Medium", *IEEE Transactions on Antennas and Propagation,* pp. 266-269 (May, 1963).

Fenwick et al., "Submerged Antenna Characteristics", *IEEE Transactions on Antennas and Propagation,* pp. 296-305 (May, 1963).

Hansen, "Radiation and Reception with Buried and Submerged Antennas", *IEEE Transactions on Antennas and Propagation,* pp. 207-216 (May, 1963).

King et al., "The Complete Electromagnetic Field of a Half-Wave Dipole in a Dissipative Medium", *IEEE Transactions on Antennas and Propagation,* pp. 275-285 (May, 1963).

Iizuka, "The Circular Loop Antenna Immersed in a Dissipative Medium", *IEEE Transactions on Antennas and Propagation,* pp. 43-47 (Jan., 1965).

Lavrov, G. et al., *Prizemnyye i Podzemnyye Antenny* [Near Earth and Buried Antennas], Chapter V, pp. 256-297 (1965, U.S.S.R.) (English translation).

Galejs, *Antennas in Inhomogenous Media,* vol. 15, p. 71 of Chapter 6 and Section 9.1 of Chapter 9 and Section 10.3 of Chapter 10 (1969).

Lee et al., "Measured Properties of Bare and Insulated Antennas in Sand", *IEEE Transactions on Antennas and Propagation,* vol. AP-23, No. 5, pp. 664-670 (Sep., 1975).

Shen et al., "Measured Field of a Directional Antenna Submerged in a Lake", *IEEE Transactions on Antennas and Propagation,* pp. 891-894 (Nov. 1976).

King et al., "Subsurface Communication Between Dipoles in General Media", *IEEE Transactions on Antennas and Propagation,* vol. AP-25, No. 6, pp. 770-775 (Nov., 1977).

Ancona, "On Small Antenna Impedance in Weakly Dissipative Media", *IEEE Transactions on Antennas and Propagation,* vol. AP-26, No. 2, pp. 341-343 (Mar., 1978).

Burrel et al., "Pulse Propagation in Lossy Media Using the Low-Frequency Window for Video Pulse Radar Application", *Proceedings of the IEEE,* vol. 67, No. 7, pp. 981-990 (Jul., 1979).

King et al., "A Comprehensive Study of Subsurface Propagation from Horizontal Electric Dipoles", *IEEE Transactions on Geoscience and Remote Sensing,* vol. GE-18, No. 3, pp. 225-233 (Jul., 1980).

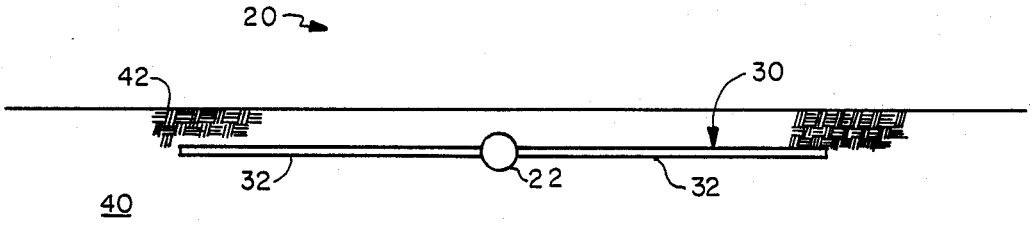
(S) Fig. 1
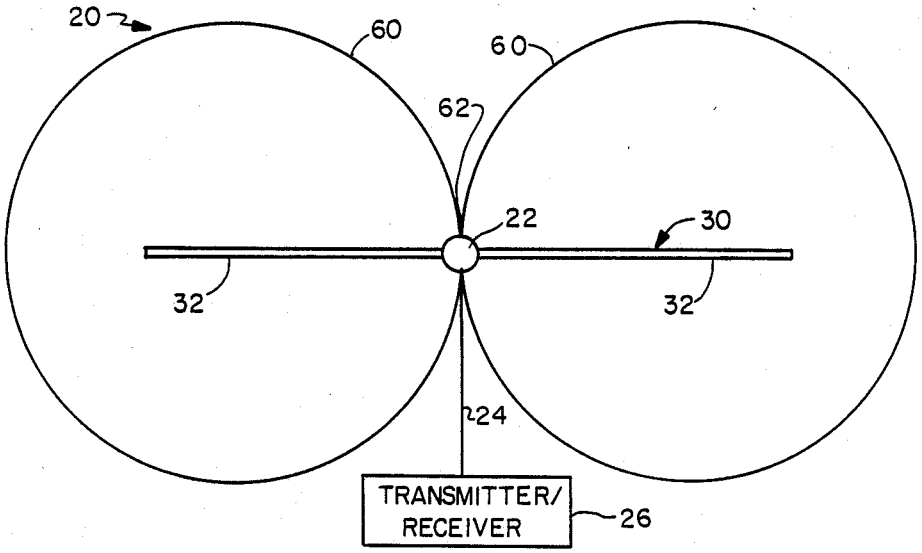
(S) Fig. 2
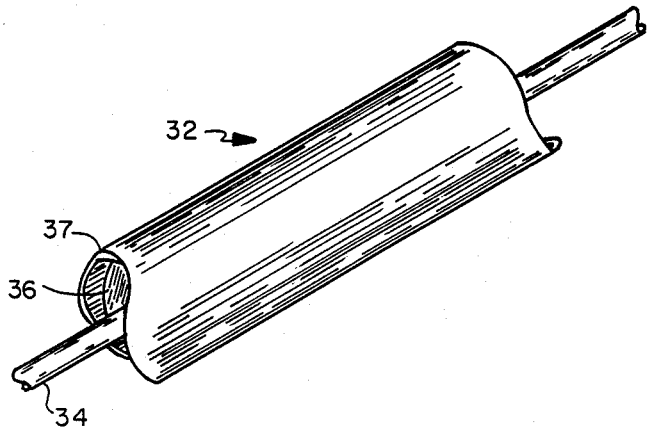
(S) Fig. 3

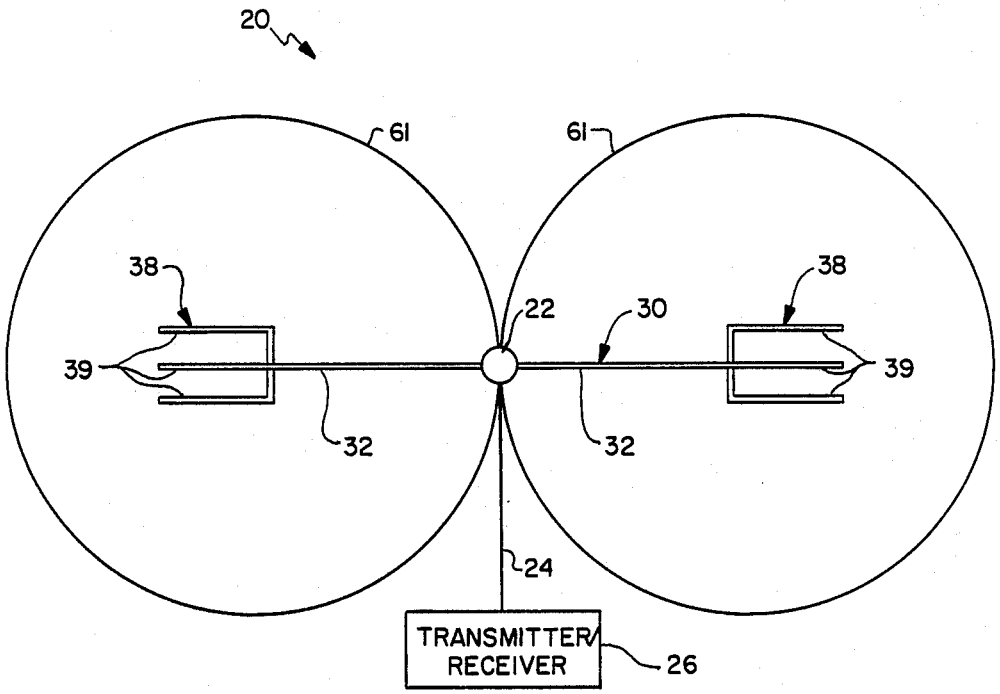
(S) Fig. 4
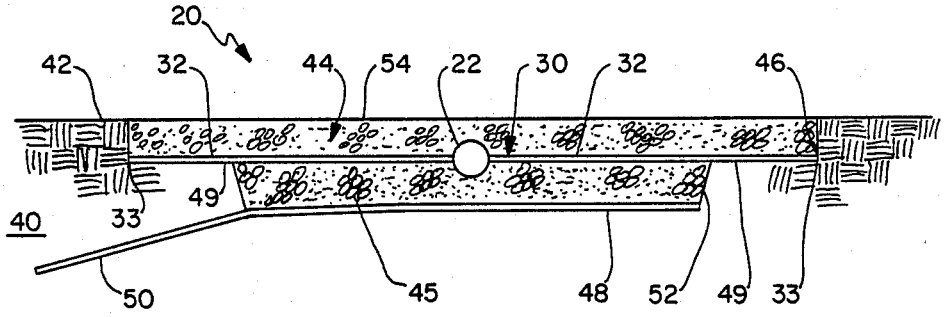
(S) Fig. 5
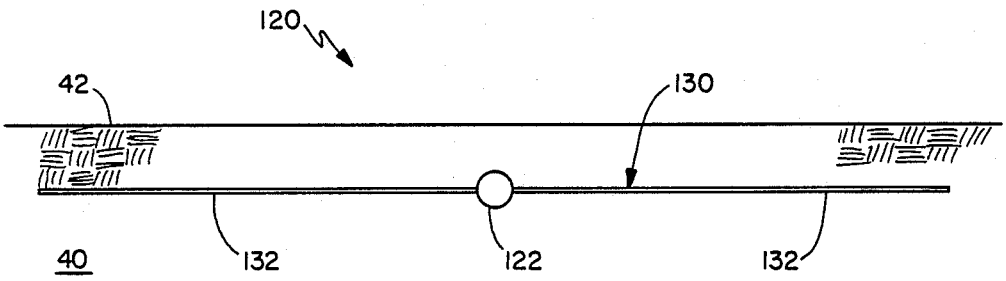
(S) Fig. 6

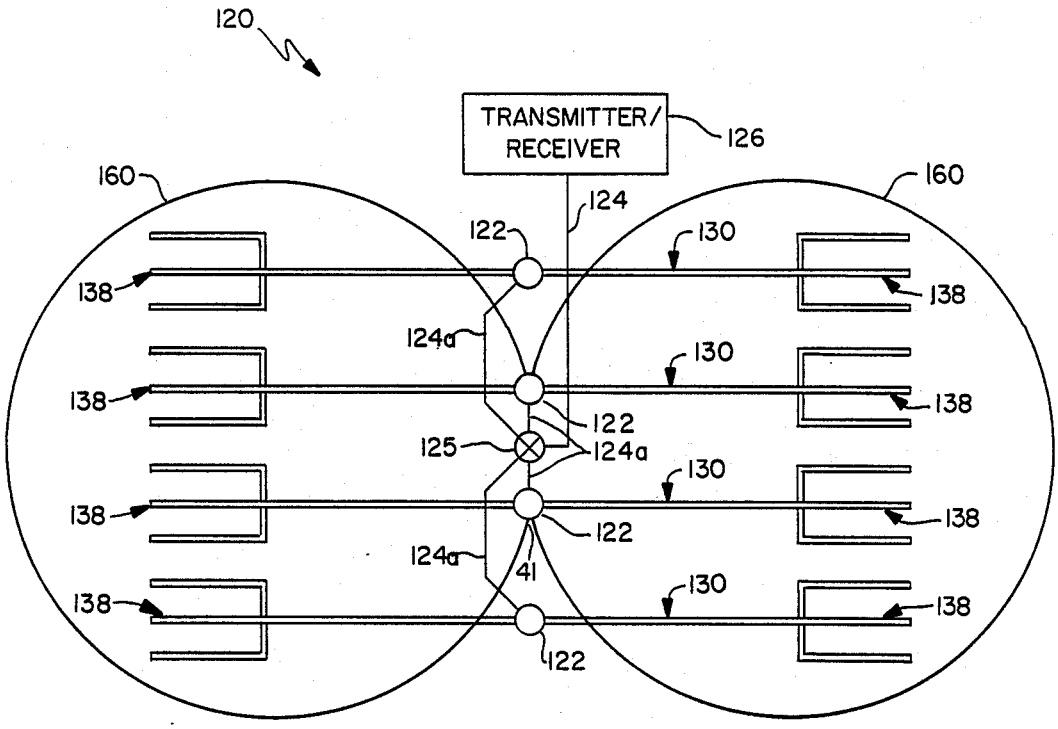
(s) Fig. 7

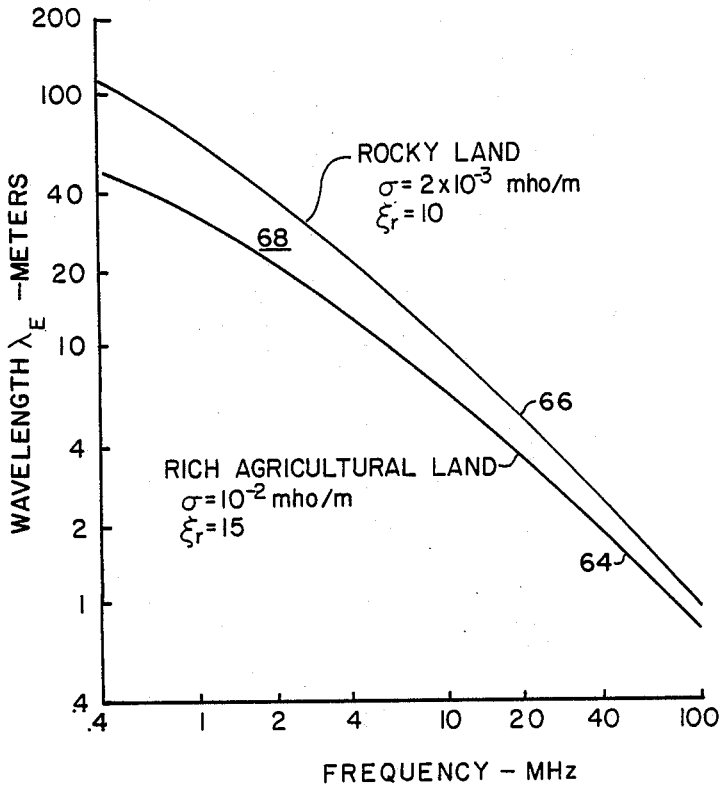
(U) Fig. 8
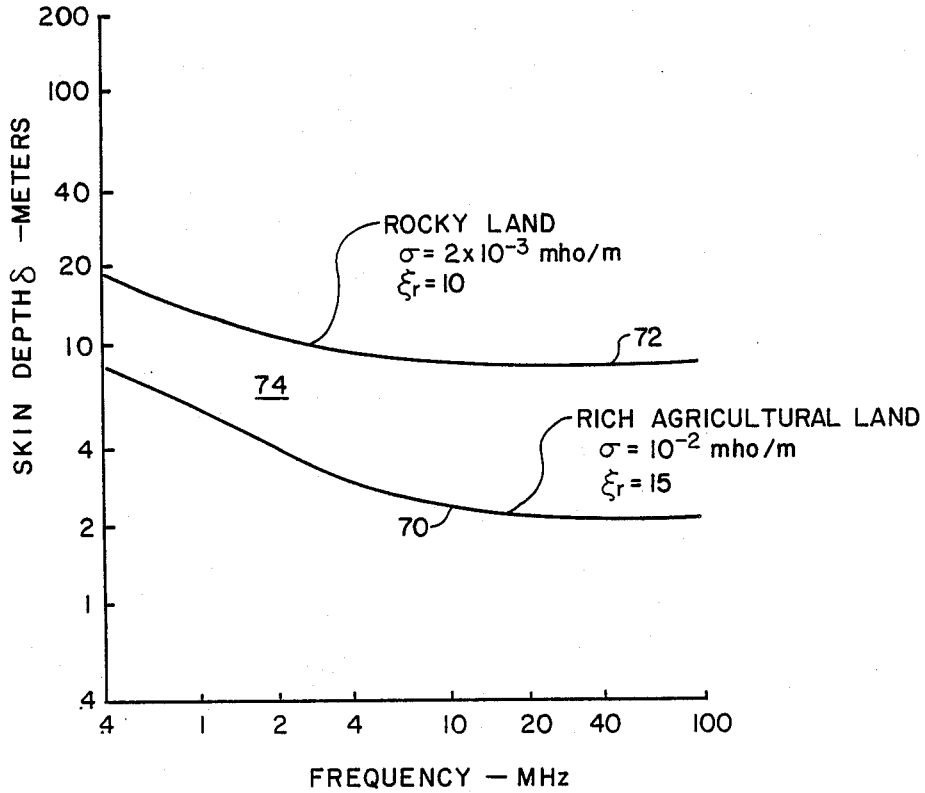
(U) Fig. 9

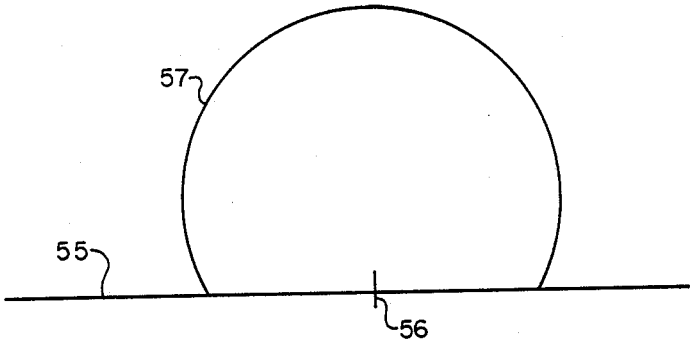
(S) Fig. 10
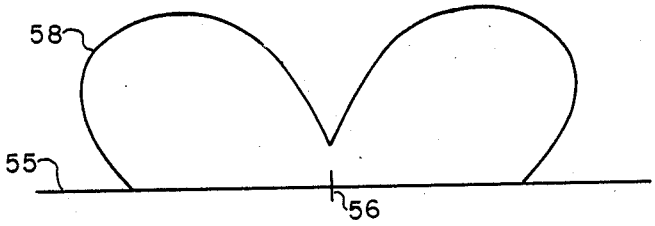
(S) Fig. 11
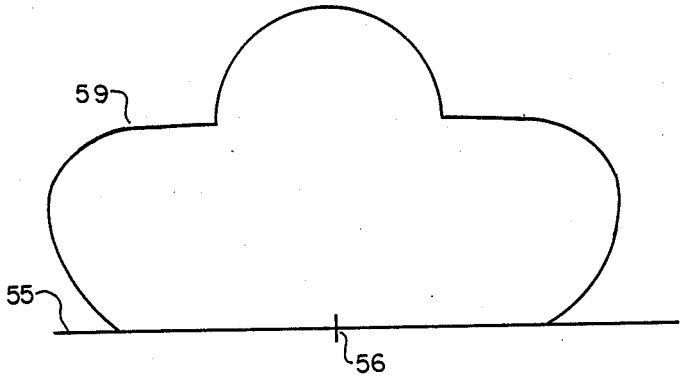
(S) Fig. 12

GUIDED WAVE ANTENNA SYSTEM AND METHOD

BACKGROUND

1. Related Application

This application is a continuation-in-part application of my copending U.S. patent application, Ser. No. 06/393,043, filed June 23, 1982, for WIRELESS COMMUNICATION SYSTEM AND METHOD USING CURRENT FORMED UNDERGROUND VERTICAL PLANE POLARIZED ANTENNAS, which is a continuation-in-part of copending U.S. patent application Ser. No. 308,080, filed Oct. 2, 1981.

2. The Field of the Invention

This invention relates to communication systems and methods, and, more particularly, to underground guided wave antenna systems and methods which have improved performance characteristics in both sending and receiving electromagnetic signals through the atmosphere over a wide bandwidth.

3. The Prior Art

Various types of communication systems which are based upon the propagation of electromagnetic signals have been known and used for many years. For example, commercial radio and television stations broadcast many hours of programming each day by transmitting appropriate electromagnetic signals through the atmosphere which are then received by individual radio and/or television receivers located within such station's broadcast area. Similarly, by both transmitting and receiving suitable electromagnetic signals, government agencies, private businesses, and individuals, are able to readily communicate over long distances, thereby transmitting and receiving data and/or instructions which may be vital to our nation's economy and/or security.

Generally, communication systems such as those described above employ large, aboveground antennas which extend high above the earth's surface in order to effectively transmit and/or receive the desired electromagnetic signals. Typical antennas may, for example, be secured several hundred feet above the earth's surface to the top of a high tower or building; and such antennas are also commonly supported by numerous guy wires which provide the antenna with additional structural stability. It is also quite common to install such antennas, together with their supporting towers and guy wires, on the slopes of relatively high mountains. By placing the antennas upon such towers and/or mountains, the range and effectiveness of the antennas can be significantly increased.

Although such conventional aboveground antennas are generally quite effective and may be constructed so as to operate very efficiently in both transmitting and receiving the desired electromagnetic signals, such antennas suffer from a significant disadvantage in that they are considered "soft" for security purposes. "Hardness" and "softness" are military terms used to denote a system's vulnerability to destruction; and the "harder" a system is, the less vulnerable to destruction such system is.

The "hardness" of a communication system is generally measured by such criteria as its ability to withstand substantial shock, as in the case of a powerful explosion occurring very near to the system, and the ability of the system to survive high energy electromagnetic pulse radiation which may be produced by a nuclear blast. Unfortunately, even though a powerful explosion may be centered some distance away from the above-described prior art antennas, the resulting shock waves will likely damage or destroy such antennas, thereby rendering the associated communication systems either totally or partially inoperative. Furthermore, such aboveground antennas which transmit or receive high frequency electromagnetic signals are very susceptible to the adverse effects of the above-mentioned electromagnetic pulse radiation.

Some attempts have been made to increase the "hardness" of communication systems which use the above-described antennas by constructing appropriate backup antenna systems. However, both economic and environmental considerations make it very difficult to either justify or construct the number of backup antenna systems which would be required in order to achieve an acceptable level of "hardness." Therefore, despite the general effectiveness of prior art aboveground antennas, the use of such antennas in communication systems which are vital to our national security remains highly undesirable.

In an effort to increase communication system "hardness," a number of proposals have been made which involve the use of antennas that are positioned underground. Significantly, underground antennas are able to withstand the effects of nearby explosions much better than conventional aboveground antennas. In addition, underground antennas are exposed to significantly less electromagnetic pulse radiation than antennas which are located aboveground. Moreover, because of the foregoing advantages, a communication system which uses underground antennas will not require as many backup antenna systems in order to achieve an acceptable level of "hardness." Thus, the use of underground antennas could potentially overcome many of the above-identified limitations of conventional aboveground antennas and provide a "hardened" communication system which can be constructed within reasonable economic and environmental constraints.

Notwithstanding the potential of underground antennas, however, the performance characteristics of prior art underground antenna systems have been largely unacceptable.

For example, a number of prior art proposals involving underground antennas contemplate that the appropriate electromagnetic signals will be propagated through the earth, rather than through the atmosphere. Such underground transmission of electromagnetic signals is, however, subject to significant exponential signal attenuation due to the earth's large dielectric constant and its high conductivity. This is due to the fact that, when electromagnetic signals are propagated through a conductive medium, such as the earth, significant amounts of signal energy are lost because of the electrical currents which are induced in the medium by the signals. As a result, the range and efficiency of the communication system is drastically impaired. By way of contrast, electromagnetic signals which are propagated through the atmosphere generally lose very little energy to the medium.

Others have suggested using underground antennas to increase the "hardness" of a communication system, while continuing to use atmosphere for electromagnetic signal propagation. For example, several past proposals involve the use of a horizontal linear electric dipole antenna which is positioned either upon or beneath the surface of the earth. (As used herein, the term "linear electric dipole" means a structure comprising two, substantially colinear, conductive arms which are separated from direct electrical contact and which extend outwardly in substantially opposite directions from the point at which such arms are electrically connected to the communication system's transmitter/receiver apparatus.) Systems using such antennas have, however, likewise experienced a significant reduction in signal strength, as compared with conventional aboveground antennas, as a result of signal attenuation and energy losses in the earth.

The performance of several prior art underground linear electric dipole antennas is examined by R. C. Fenwick and W. L. Weeks, in Submerged Antenna Characteristics, I.E.E.E. TRANSACTIONS ON ANTENNAS AND PROPAGATION, pp. 296–305 (May, 1963). In that paper, the authors compare the performance of several prior art underground dipole antennas with that of a preselected reference antenna. Notably, the reference antenna (a perfect quarter-wave vertical monopole antenna) is similar to many of the conventional aboveground antennas which are now in use. The authors' comparison indicates that, in many common situations such as LF and MF the strength of the signals produced by the underground dipole antenna is more than 30 decibels (hereinafter "dB") weaker than the strength of the signals produced by the reference antenna. In other words, the signal strength of the prior art underground dipole antennas is often more than 1,000 times less than the signal strength which can be obtained using a conventional aboveground antenna. Such a reduction in signal strength is simply not acceptable for many communication system applications, especially when such applications require long-range signal transmission and reception.

In addition to the above-indicated problem, the horizontal dipole antennas of the prior art radiate electromagnetic signals which propagate in directions which are generally perpendicular to the longitudinal axis of the dipole antenna. As a result, much of the signal strength is directed either substantially straight upwards or into the ground where it is either lost or largely unusable. This situation, of course, results in significant amounts of power loss and in greatly reduced efficiency in the communication system.

A number of other prior art proposals involve the use of an underground loop antenna for transmitting electromagnetic signals through the atmosphere. Such antennas typically comprise a substantially linear conductor which is configured as a closed loop; and such loop may lie either in a substantially horizontal or in a substantially vertical plane. As with the prior art underground antennas described above, however, prior art underground loop antennas are also generally subject to significant signal attenuation and energy losses. In addition, prior art underground loop antennas must typically be quite large in order to effectively transmit and/or receive the electromagnetic signals. For example, a prior art underground loop antenna which is used to transmit and/or receive electromagnetic signals having a frequency of 400 KHz may require a loop perimeter length of approximately 100 meters. This, of course, makes it quite expensive to support and bury such antennas, particularly when the loop antennas are positioned vertically.

From the foregoing, it can be seen, therefore, that prior art underground antennas generally have relatively poor performance characteristics and have been significantly less efficient than conventional aboveground antennas. As a result, prior art underground antennas have generally had only limited and very specific applications and have been wholly unable to adequately function as permanent replacements for the more efficient aboveground antenna systems.

BRIEF SUMMARY AND OBJECTS OF THE INVENTION

In view of the foregoing, it is a primary object of the present invention to provide a communication system and method which permits high quality communication while having sufficient "hardness" to survive all but a direct hit by a nuclear weapon.

It is another object of the present invention to provide sufficient antenna efficiency for high quality, long distance atmospheric propagation of electromagnetic communication signals between underground transmitting and receiving antennas.

It is still another object of the present invention to provide a communication system having underground antennas which is capable of transmitting and receiving electromagnetic signals over a wide frequency band without tuning and at data rates which are comparable to communication systems having conventional aboveground antennas.

Further, it is an object of the present invention to provide an underground antenna system which is configured so as to significantly reduce the physical antenna conductor length which is required in order to transmit and receive electromagnetic signals at various frequencies.

It is a still further object of the present invention to provide an underground antenna system which is installed in an environment of controlled conductivity so as to provide an efficient communication system in typically conductive mediums.

It is also an object of the present invention to provide a long distance communication system having an underground guided wave antenna which is configured so as to make it economically feasible to construct backup antenna systems in order to achieve an acceptable level of "hardness."

Additionally, it is an object of the present invention to provide an effective underground antenna system which is relatively inexpensive to construct and maintain.

Another valuable object of the present invention is to provide a high power, long distance antenna system which does not degrade the surrounding environment and which is easily camouflaged.

Consistent with the foregoing objects, the present invention is directed to a novel underground guided wave antenna system and method. The antenna system comprises one or more substantially linear radiating elements, such as, for example, a linear electric dipole, which are buried in the earth so as to lie no more than approximately one meter below the earth's surface. The radiating elements are electrically insulated along their entire length; and the effective electrical length of each radiating element is at least one-third of the wavelength in the earth of the electromagnetic signals being propagated. Advantageously, in order to increase the effective electrical length of the radiating elements without significantly increasing their physical length, one or both ends of each radiating element may be provided with a "tree" or multiple parallel wire termination.

In order to increase the efficiency of the antenna system, especially when the electromagnetic signals being propagated are in the high frequency range, the radiating elements may be surrounded by a "low loss" dielectric substance. That is, a substance which has both a low conductivity and a relatively low dielectric coefficient. Such a substance helps minimize energy losses in the eart, thereby providing greater signal strength ("gain"). Additional advantages can be obtained by configuring the dielectric substance such that one or both ends of each radiating element remain substantially adjacent the relatively highly conductive earth, while the remainder of each radiating element is surrounded by the low loss dielectric substance. With such a configuration, the ends of each radiating element cooperate with the earth to substantially suppress reflection of the electromagnetic signals and reduce wave velocity near the ends, thereby further increasing the efficiency and gain of the antenna system while reducing required antenna size.

Additionally, the gain of the antenna system can be further enhanced by forming an underground array using a plurality of buried radiating elements which are positioned substantially parallel to one another in substantially the same horizontal plane. Unlike above-ground antenna arrays, the radiating elements in such an underground array can be positioned relatively close to each other (within approximately 3–6 meters in most HF communication applications), and the resulting radiation pattern is substantially the same as that of a single radiating element unless the array size becomes large compared to a half wavelength in air. Significantly, the performance of such an array is proportional to the number of elements used. At HF the gain may be very nearly the same as that of conventional above-ground antennas. Large improvements are possible over single element systems at all frequencies.

The efficiency can be further improved by using thick, low loss insulation (at least twice the thickness of the element wire) about each element. This reduces losses on the elements.

The foregoing and other objects and features of the present invention will become more fully apparent from the following description and appended claims, taken in conjunction with the accompanying drawings.

BRIEF DESCRIPTION OF THE DRAWINGS

FIG. 1 is a schematic representation of one presently preferred embodiment of the guided wave antenna system of the present invention.

FIG. 2 is a top plan view of the embodiment of FIG. 1, with the resulting azimuth ground wave radiation pattern superimposed thereon.

FIG. 3 is an elevational view of one presently preferred embodiment of the arms of each radiating element, with parts of the insulation material being broken away so as to more clearly reveal the construction.

FIG. 4 is a top plan view of a second presently preferred embodiment of the guided wave antenna system of the present invention, with the resulting azimuth ground wave radiation pattern superimposed thereon.

FIG. 5 is a schematic representation of a third presently preferred embodiment of the guided wave antenna system of the present invention.

FIG. 6 is a schematic representation of a fourth presently preferred embodiment of the guided wave antenna system of the present invention which comprises several parallel radiating elements.

FIG. 7 is a top plan view of the embodiment of FIG. 6, with the resulting ground wave radiation pattern superimposed thereon.

FIG. 8 is a graph which represents the electromagnetic signal wavelength in the earth as a function of frequency.

FIG. 9 is a graph which represents the electromagnetic signal penetration or skin depth in the earth as a function of frequency.

FIG. 10 is a graphical representation of the sky wave elevation radiation pattern of the guided wave antenna system of the present invention, wherein the effective electrical length of the radiating elements of the system is equal to approximately one-half of the wavelength in the earth of the electromagnetic signals being propagated.

FIG. 11 is a graphical representation of the sky wave elevation radiation pattern of the guided wave antenna system of the present invention, wherein the effective electrical length of the radiating elements of the system is equal to approximately one wavelength in the earth of the electromagnetic signals being propagated.

FIG. 12 is a graphical representation of the sky wave elevation radiation pattern of the guided wave antenna system of the present invention, wherein the effective electrical length of the radiating elements of the system is greater than approximately one wavelength in the earth of the electromagnetic signals being propagated.

DETAILED DESCRIPTION OF THE PREFERRED EMBODIMENTS

The presently preferred embodiments of the invention will be best understood by reference to the drawings, wherein like parts are designated with like numerals throughout.

1. General Discussion

The basic configuration of the guided wave antenna system of the present invention, designated generally at 20, is illustrated in FIGS. 1 and 2. As shown, antenna systema 20 comprises a substantially linear radiating element 30 which is buried in the earth 40 so as to lie a distance below the earth's surface 42. Radiating element 30 is connected by means of a suitable coupling 22 to one end of a transmission line 24. The other end of transmission line 24 is connected to a transmitter/-receiver apparatus 26.

Antenna system 20 can be used both to transmit and receive ground waves (i.e., electromagnetic signals which are propagated along the earth's surface) and/or sky waves (i.e., electromagnetic signals which are propagated away from the earth's surface and which may thereafter be reflected by the ionosphere).

In transmitting, transmitter/receiver apparatus 26 is used in a conventional fashion to generate electrical signals which are then carried along transmission line 24 to radiating element 30. When such electrical signals reach radiating element 30, a current is induced in radiating element 30 which causes appropriate electromagnetic signals to be propagated above the earth's surface 42, in a manner to be described in more detail below.

In receiving electromagnetic signals which are propagated from a distant antenna, antenna system 20 operates in a similar manner. Upon reaching antenna system 20, such electromagnetic signals excite a current in radiating element 30. This current causes electrical signals to travel along transmission line 24 to transmitter/-receiver apparatus 26. These electrical signals are then transformed into appropriate audio and/or video signals by transmitter/receiver apparatus 26 in a conventional fashion.

One of the chief advantages of antenna system 20 of the present invention is that it is very difficult to destroy except by means of a direct hit with a powerful weapon. Perhaps more importantly, however, when antenna system 20 is constructed as outlined below, its performance characteristics are remarkably superior to buried antennas which are described in the prior art. In fact, the performance characteristics of antenna system 20 in many cases approach the performance characteristics of conventional aboveground antenna systems.

In the discussion which follow, the structure of antenna system 20 is first described, followed by a description of the preferred method for installing antenna system 20 at a particular site. Thereafter, a more detailed description of the operation of antenna system 20 is set forth.

2. Antenna Structure

Referring again to FIGS. 1 and 2, one presently preferred embodiment of guided wave antenna system 20 is illustrated. As shown, antenna system 20 comprises a substantially linear radiating element 30 which is buried in the earth 40 a distance below the earth's surface 42.

As depicted herein, radiating element 30 may comprise two conductive arms 32 which are substantially colinear and which extend outwardly in opposite directions. Thus, as illustrated in FIGS. 1 and 2, radiating element 30 may be configured as a symmetrical linear electric dipole. Alternatively, radiating element 30 may be formed as an asymmetrical linear electric dipole by making conductive arms 32 of radiating element 30 unequal in length. Also, radiating element 30 could be comprised of a single conductive arm 32. Such variations in the configuration of radiating element 30 will have an effect upon the radiation pattern of antenna system 20 which will be discussed in more detail below.

In addition, FIGS. 1 and 2 depict a radiating element 30 which is driven from a point near its center. That is, coupling 22 (which connects radiating element 30 to transmission line 24), is connected to radiating element 30 at a point near the center of radiating element 30. It will, however, be readily appreciated that radiating element 30 could be driven from one end, if desired, by means which are known in the art.

Importantly, radiating element 30 is covered with a thick low loss insulation material along its entire length such that radiating element 30 is electrically insulated from the surrounding earth 40. Such insulation material helps reduce energy losses in the earth which would otherwise result if radiating element 30 were in direct electrical contact with the earth 40.

One presently preferred configuration for radiating element 30 and the associated insulation material is illustrated in FIG. 3. As shown, each conductive arm 32 of radiating element 30 comprises a linear electrical conductor 34. Conductor 34 may be formed of any suitable conductive material such as, for example, copper or aluminum. Moreover, conductor 34 may be either a solid member or a hollow member; and, although conductor 34 is illustrated herein as being substantially circular in cross-section, it will be appreciated that conductor 34 may have any of a number of different cross-sectional shapes.

Surrounding conductor 34 of conductive arms 32 is an insulation material 36. Insulation material 36 may, for example, comprise some type of plastic material, such as, for example, polyethylene plastic. In addition, surrounding insulation material 36 is a sheath of water resistant material 37. Water resistant material 37 may, for example, comprise polyvinyl chloride.

Although the configuration of radiating element 30 and the associated insulation material which is illustrated in FIG. 3 is one presently preferred configuration, it will be readily appreciated that numerous other configurations come within the scope of the present invention. For example, conductor 34 might be surrounded by wood as a mechanical protection from sharp rocks as well as an insulation material. In addition, the wood might be treated with a water resistant material in order to both increase the life of the wood and prevent moisture from seeping through the wood and coming into contact with conductor 34. Other types of insulation material which are known in the art could also be used to surround conductor 34, if desired.

Importantly, the insulation material which surrounds radiating element 30 must be of sufficient thickness to effectively prevent significant near field energy losses in the earth during antenna operation. Thus, it is presently preferred that insulation material 36 be at least two times as thick as the cross-sectional thickness of linear conductor 34. In this manner, energy losses in the earth 40 may be reduced, and the efficiency of antenna system 20 may be significantly enhanced.

In order to permit proper operation of antenna system 20, radiating element 30 must also be of the appropriate electrical length. Accordingly, the effective electrical length of radiating element 30 should be at least one-third of the wavelength ($\lambda_E$), as measured in the earth, of the electromagnetic signals being propagated. In fact for low elevation angles, it has generally been found desirable to make radiating element 30 as long as practicable, given the economic and environmental considerations which must be taken into account in installing a particular antenna system 20. Significantly, by making radiating element 30 as long as practicable, radiating element 30 will be at least as long as one-half of the wavelength of the electromagnetic signals over a wide bandwidth of usable frequencies.

The wavelength of various frequencies of electromagnetic signals, as measured in the earth, is illustrated graphically in FIG. 8. Graph line 64 represents the wavelength in meters of the electromagnetic signals as a function of frequency in rich agricultural land having a conductivity of $10^{-2}$ mho per meter. Graph line 66 indicates the wavelength in meters as a function of frequency in rocky land having a conductivity of $2\times10^{-3}$ mho per meter. Thus, the area 68 between lines 64 and 66 represents the electromagnetic signal wavelength as a function of frequency in the majority of typical kinds of ground media. For near surface elements the wavelengths will be somewhat greater than that shown in FIG. 8.

The mathematical equation for determining the wavelengths represented by lines 64 and 66 of FIG. 8 is:

$$\lambda_E = \frac{1}{f\sqrt{\frac{\mu\epsilon}{2}\left(\sqrt{1+\left(\frac{\sigma}{\omega\epsilon}\right)^2}+1\right)}}$$

where $\lambda_E$=wavelength of the electromagnetic signals in the earth (meters);

$\mu$=permeability of the earth ($4\pi\times10^{-7}$ weber/ampmeter);
$\epsilon=\epsilon_0\epsilon_r$=permittivity of the earth (farad/meter);
$\epsilon_0$=permittivity of free space ($8.85\times10^{-12}$ farad/meter);
$\epsilon_r$=relative permittivity of the earth;
$\sigma$=conductivity of the earth (mho/meter);
$\omega=2\pi f$; and
f=frequency of the electromagnetic signals (Hz).

Thus, for example, in the case of a communication system operating at a frequency of 400 KHz, the foregoing equation indicates that the electromagnetic signals wavelength is equal to approximately 106 meters when the signals are propagated through rocky land. The effective electrical length of radiating element 30 in such case would, therefore, need to be at least 53 meters.

In some cases, it may not be desirable to use a radiating element 30 whose actual physical length is equal to the required effective electrical length as calculated above. For example, factors such as cost, environmental preservation, and space constrains may sometimes militate against the use of a radiating element 30 having such a length. In such cases, radiating element 30 will need to be configured so as to have the required effective electrical length while having a significantly shorter physical length. That is, radiating element 30 must be configured so as to function as though its length was equal to the required effective electrical length, even though the physical length of radiating element 30 is actually much shorter. FIG. 4 illustrates one presently preferred configuration for radiating element 30 which accomplishes this objective.

As depicted in FIG. 4, radiating element 30 may be configured to comprise two conductive arms 32 which are each provided with a conductive tree termination 38. As shown, tree terminations 38 each comprise a number of insulated conductors 39 which are positioned parallel to one another and are electrically connected to conductive arms 32. The length and number of conductors 39 which comprise each tree termination 38 will depend upon the total effective electrical length which is required. The effective electrical length of radiating element 30 is a function of both the size of tree terminations 38 and the number and spacing of the individual conductors 39 which comprise such tree terminations 38. It has been found in most situations, for example, that three tree terminations 38 may be used to obtain the required effective electrical length of radiating element 30 and that conductors 39 of each such tree termination 38 may be spaced approximately two feet apart.

Referring again to FIG. 1, it will be seen that radiating element 30 may be buried directly in the earth 40. Although radiating element 30 may function adequately in some cases if it is buried at an angle with respect to the earth's surface 42, it is presently preferred that radiating element 30 be buried so as to be approximately parallel to the earth's surface 42, as shown.

In addition, radiating element 30 should be buried deep enough in the earth 40 so as to provide adequate system hardness. At the same time, however, radiating element 30 should not be buried so deep that the performance characteristics of antenna system 20 fall below acceptable levels. It is, therefore, presently preferred that radiating element 30 be buried in the earth 40 so as to lie no more than approximately one meter below the earth's surface 42. When an array of elements is used as shown in FIG. 7 the spacing between elements should be one-half skin depth or greater. A "skin depth" is a common engineering term that is used to denote the distance which electromagnetic signals of a given frequency must travel in a particular medium before the amplitude of such signals is reduced by a factor of 1/e (where e is the root of the natural logarithm and is equal to approximately 2.718). As used herein, "skin depth" will refer exclusively to such a distance as measured in the earth.

The skin depth of electromagnetic signals is dependent upon both the properties of the earth through which such signals are propagated and upon the frequency of the electromagnetic signals. The skin depth of various frequencies of electromagnetic signals is graphically illustrated in FIG. 9. Graph line 70 represents the skin depth in meters of electromagnetic signals as a function of frequency in rich agriculatural land having a conductivity of $10^{-2}$ mho per meter. Graph line 72 indicates the skin depth in rocky land having a conductivity of $2\times10^{-3}$ mho per meter. Hence, the area 74 between lines 70 and 72 represents the skin depth of electromagnetic signals in the majority of typical kinds of ground media.

The mathematical equation for determining the skin depth represented by lines 70 and 72 in FIG. 9 is:

$$\delta=\frac{1}{\omega\sqrt{\frac{\mu\epsilon}{2}\left(\sqrt{1+\frac{\sigma^2}{\omega^2\epsilon^2}}-1\right)}}$$

where
$\delta$=skin depth of the electromagnetic signals (meters);
$\omega=2\pi f$;
f=frequency of the electromagnetic signals (Hz);
$\mu$=permeability of the earth ($4\pi\times10^{-7}$ weber/ampmeter);
$\nu$=conductivity of the earth (mho/meter);
$\epsilon_0\epsilon_r$=permittivity of the earth (farad/meter);
$\epsilon_0$=permittivity of free space ($8.85\times10^{-12}$ faradmeter); and
$\epsilon_r$=relative permittivity of the earth.

Even if the foregoing specifications are adhered to, it will be found in some situations that antenna system 20 will not function adequately if radiating element 30 is buried directly in the earth 40. Such is particularly the case when the earth 40 is relative highly conductive or has a high dielectric constant and the electromagnetic signals have relatively high frequencies. In such cases, the configuration of antenna system 20 must be modified slightly in order to insure adequate system performance. One such presently preferred modification is illustrated in FIG. 5.

As shown in FIG. 5, radiating element 30 may be surrounded by a low loss dielectric fill material 44; that is, by a material which has a relatively low dielectric constant and a relatively low conductivity. It is presently preferred, for example, that the conductivity of dielectric fill 44 be no greater than approximately $1\times10^{-3}$ mho per meter, while the relative dielectric constant of dielectric fill 44 be no greater than approximately 3. (The "relative dielectric constant" of a substance is equal to the ratio of its actual dielectric constant to the dielectric constant of free space, which is equal to approximately $8.85\times10^{-12}$ farad/meter). Accordingly, dielectric fill 44 may, for example, comprise dry crushed rock.

As also illustrated in FIG. 5, it is presently preferred that a central portion of radiating element 30 be entirely surrounded by dielectric fill 44, while portions of radiating element 30 adjacent the ends 33 thereof are substantially adjacent the earth 40. This configuration for dielectric fill 44 improves the operation of antenna system 20 by reducing energy losses in the earth. In addition, such a configuration enables antenna system 20 to function as a long wire guided wave antenna in that the ends 33 of radiating element 30 are capacitively coupled to the adjacent conductive earth 40, thereby effectively suppressing any reflected electromagnetic signals.

It is also desirable to protect radiating element 30 against exposure to water which could interfere with the proper functioning of antenna system 20. Therefore, it is presently preferred that dielectric fill 44 be comprised of crushed rock which is capable of passing through a grading screen with substantially square openings having dimensions within the range of approximately one inch (2.54 cm) to approximately two inches (5.08 cm) on a side. Thus, dielectric fill 44 will typically comprise pieces of rock 45 which will facilitate the drainage of any water.

In addition, a non-conductive drainage system 50 may be provided immediately below radiating element 30 so as to collect any water which drains down through dielectric fill 44. As shown, drainage system 50 may be configured so as to convey such water away from regions of the earth 40 which are adjacent radiating element 30, thereby permitting antenna system 20 to function adequately even in inclement weather.

Also, it may in some cases be advantageous to provide a water resistant liner 52 immediately adjacent the earth 40 so as to lie below radiating element 30 and dielectric fill 44. Such a liner 52 will prevent moisture from seeping through the earth 40 and coming into contact with radiating element 30. Similarly, a water resistant cover 54 may be placed above radiating element 30 so as to shield radiating element 30 and dielectric fill 44 from any moisture resulting from precipitation. Liner 52 and cover 54 may be formed of any suitable water resistant materials. For example, liner 52 and cover 54 may comprise a thin polyvinyl chloride sheet. Alternatively, liner 52 and cover 54 may comprise a suitable layer of asphalt material.

Importantly, when using a liner 52 and/or a cover 54, care should be exercised to insure that liner 52 and cover 54 are configured so as to facilitate adequate water drainage. It would, for example, be undesirable to allow liner 52 and/or cover 54 to collect or pool water, as this would significantly interefere with the operation of antenna system 20. Accordingly, it may be desirable to slope the earth's surface 42 in such a manner so as to encourage drainage of the water off from cover 54. Likewise, it may be advantageous to configure liner 52 in such a manner that all moisture which might collect thereon is conveyed down to drainage system 50 where it may then be conveyed away from regions of the earth 40 adjacent radiating element 30.

As illustrated schematically in FIGS. 2 and 4, radiating element 30 is connected to a transmission line 24 by means of a coupling 22. Coupling 22 may comprise any of a number of commercially available couplings which are conventionally used on antenna systems. The type of coupling 22 which is used in a particular antenna system 20 will in part depend upon the configuration of transmission line 24.

For example, it is quite common to employ a coaxial cable as a transmission line 24. Such a transmission line is called an "unbalanced" transmission line because it tends to reflect a portion of the current from radiating element 30 back toward transmitter/receiver 26, which, in turn, results in an "unbalanced" current on radiating element 30. That is, the current on one arm 32 of radiating element 30 would not be equal in magnitude to the current on the other arm 32 of radiating element 30. Since it is generally desirable to have a balanced current on radiating element 30, a device called a "balun" (short for "balance-to-unbalance" transformer) may be used as a coupling 22 to couple transmission line 24 to radiating element 30. This inhibits the above-mentioned reflected current and insures that a "balanced" current is provided to radiating element 30.

It is also common, however, to employ a parallel two-wire "balanced" transmission line in antenna systems. In such a case, it would be unnecessary to use a "balun" for coupling 22, as described above. Rather, transmission line 24 could be coupled directly to radiating element 30 without producing an "unbalanced" current on radiating element 30.

When choosing a suitable coupling 22, it is also desirable that the impedance of transmission line 24 be matched to that of radiating element 30. As is well known, matching the impedance in this manner will result in maximum power being transferred from transmission line 24 to radiating element 30, thereby increasing the efficiency of antenna system 20. A number of well-known means are available for matching the impedance of transmission line 24 to radiating element 30. For example, some type of matching network might be used to match the impedance. A network is, however, generally considered disadvantageous in that it has a relatively narrow bandwidth and generally gives rise to significant energy losses.

The presently preferred method for matching the impedance of transmission line 24 to that of radiating element 30 is to use a transformer balun which also has the necessary configuration to provide an appropriate impedance match. Such baluns are well known in the art and are commercially available from a number of sources. Alternatively, the impedance of radiating element 30 may be selected such that it can be matched directly to that of transmission line 24 by means of a simple parallel coupling.

Although a single radiating element 30 which is configured as described above will perform adequately in a number of different applications, a single radiating element 30 will often not be able to provide sufficient signal strength ("gain") to transmit electromagnetic signals over long distances. In such cases, it is desirable to employ an array of underground radiating elements in order to increase the efficiency (or "gain") of the antenna system.

One presently preferred array configuration is illustrated in FIGS. 6 and 7. As shown, a plurality of insulated radiating elements 130 are positioned so as to lie substantially in the same horizontal plane below the earth's surface 42. As illustrated herein, each radiating element 130 is configured essentially the same as the single radiating element 30 depicted in FIG. 4. That is, each radiating element 130 comprises two conductive arms 132 which are terminated in conductive tree terminations 138 (see FIG. 7). Similarly, both the burial depth and the effective electrical length of each radiating element 130 are determined in accordance with the criteria set forth above in connection with FIGS. 1 through 5. Moreover, for the reasons outlined above, it may sometimes be advantageous to bury the entire antenna array 120 in a dielectric fill 44, as illustrated in FIG. 5 in connection with a single radiating element 30.

Referring now to FIG. 7, radiating elements 130 are aligned so as to be substantially parallel to one another. Importantly, radiating elements 130 are spaced far enough apart that the effects of mutual coupling between radiating elements 130 are minimized. In other words, there is a sufficient distance between radiating elements 130 such that radiating elements 130 do not significantly interfere with each other during normal operation of antenna array 120.

In conventional aboveground antenna arrays, the various radiating elements of the array must typically be positioned approximately one-half wavelength apart in order to minimize the effects of mutual coupling to an acceptable degree. This often means, for example, that the various radiating elements must be positioned several hundred meters apart. With the buried antenna array 120 of the present invention, however, such a large separation distance is not required. In fact, it has been found that an element separation distance equal to approximately one-half of the skin depth is generally adequate. Thus, as shown in FIG. 9, a separation distance of only 5 meters would suffice in most HF cases. Antenna array 120 can, therefore, be confined within a reasonable geographic area and can also be constructed with relatively little additional expense.

Significantly, adding additional radiating elements so as to form an underground antenna array greatly increases the resulting electromagnetic signal strength ("gain"). In fact, the gain of an underground antenna array is approximately N times the gain of a single radiation element, where N is the number of individual radiating elements in the array. Thus, in the antenna array 120 depicted in FIG. 7, the gain of array 120 is approximately four times the gain of a single radiating element 130. This surprising result allows an antenna array 120 to function quite efficiently and, in fact, comparably to conventional aboveground antenna systems.

As further depicted in FIG. 7, radiating elements 130 of antenna array 120 are connected to transmission line 124 in a manner which is quite similar to that described in connection with FIGS. 2 and 4. As shown in FIG. 7, transmission line 124 is connected to a power splitter 125 which divides the system power equally between a number of transmission lines **124*a* corresponding to the number of radiating elements 130 in antenna array 120. Transmission lines 124*a* are then connected to suitable couplings 122 which are, in turn, connected to the various radiating elements 130**.

Importantly, power splitter 125 and transmission lines **124*a* are normally configured such that radiating elements 130 are driven simultaneously in phase with one another. This will typically require that transmission lines 124*a* have substantially the same electrical length. Optionally, however, the phase relationship between the various radiating elements 130 of antenna array 120 could be controlled and varied using conventional "phase driven" array techniques. In such case, the radiating pattern 160 of antenna array 120** could be selectively rotated about a substantially vertical axis, as desired.

3. Antenna System Burial Method

The presently preferred method of burial for the guided wave antenna system of the present invention is best described with reference to FIG. 5.

First, a trench 46 is formed in the earth 40 at a desired geographical location. If possible, the geographical location should be chosen such that the surrounding earth 40 has a relatively low conductivity, such as, for example, in the case of rocky land. If a dielectric fill substance 44 is not to be used, the depth of trench 46 is merely the desired burial depth of radiating element 30. Radiating element 30 is then placed in trench 46, connected to transmitter/receiver apparatus 26 via transmission line 24, and covered with earth 40.

If, on the other hand, radiating element 30 is to be surrounded with a dielectric fill 44, as depicted in FIG. 5, a different procedure will need to be followed. In such case, trench 46 is formed as a two level trench, as illustrated in FIG. 5. Thus, a central portion 48 of trench 46 is somewhat deeper than end portions 49 of trench 46; and, as shown, end portions 49 of trench 46 are approximately the same depth as the desired burial depth of radiating element 30. Accordingly, end portions 49 of trench 46 may be within the range of approximately two meters to approximately ten meters deep, while central portion 48 of trench 46 may be approximately one or two meters deeper than end portions 49.

After trench 46 is formed in the manner described above, a drainage system 50 is installed in trench 46 so as to provide for adequate drainage of any water away from regions of the earth 40 which will be adjacent radiating element 30. Finally, if a water resistant liner 52 is to be used, such liner 52 is next installed in the bottom of trench 46.

With trench 46 thus prepared, central portion 48 of trench 46 is filled with a dielectric fill 44. As mentioned above, it is preferable that dielectric fill 44 be comprised of crushed, dry rock 45 which is capable of passing through a grading screen with substantially square openings having dimensions within the range of approximately one inch (2.54 cm) to approximately two inches (5.08 cm) on a side. Significantly, central portion 48 of trench 46 is filled until it is substantially the same height as end portions 49 of trench 46. Thus, a substantially level bedding for radiating element 30 is provided.

Radiating element 30 is next placed in trench 46 so as to be positioned as shown. Specifically, ends 33 of radiating element 30 lie substantially adjacent the earth 40 which forms end portions 49 of trench 46. The central portion of radiating element 30, on the other hand, lies on top of dielectric fill 44. Radiating element 30 is then provided with a suitable coupler 22 and is connected to the transmission line 24 which will later be connected to a transmitter/receiver apparatus 26 (see FIGS. 2 and 4).

With radiating element 30 thus in place, the remainder of trench 46 is filled with dielectric fill 44.

Optionally, it may be desirable to slope the earth's surface above radiating element 30 so as to facilitate water runoff. Also, a water resistant cover 54 may be provided over radiating element 30, if desired.

As another construction option the antenna system may be placed in a mound of crushed rock. This allows for natural water drainage at the base of the mound.

4. Antenna System Operation

When antenna system 20 is configured and installed as described above, it may function at some frequencies as a long wire guided wave or slow wave antenna such that the electromagnetic signals travel continuously along the antenna conductors toward the ends thereof, rather than being reflected from the conductor ends so as to form a standing wave pattern. It may also operate as a resonant dipole structure at lower frequencies with a standing wave, as described and claimed in my copending applications Ser. Nos. 393,043 and 308,080, filed June 23, 1982 and Oct. 2, 1981, respectively, and incorporated herein by reference.

In the present case, therefore, antenna system 20 receives electrical signals along transmission line 24 which induce a traveling wave on radiating element 30. Notably, reflected waves are substantially suppressed due to the capacitive coupling between radiating element 30 and the earth 40. This induced traveling wave then produces a ground wave radiation pattern 60 of electromagnetic signals above the earth's surface 42, as illustrated in FIG. 2.

Radiation pattern 60 is illustrated in FIG. 2 in a conventional manner whereby the electromagnetic signal strength in any given direction is proportional to the distance from the center of radiating element 30 to the point on the radiation pattern curve lying in such direction. Thus, as shown in FIG. 2, antenna system 20 has its greatest signal strength along the longitudinal axis of radiating element 30, while a sharp null 62 exists in the direction which is perpendicular to radiating element 30.

It should here be noted that the radiating pattern 61 illustrated in FIG. 4 resulting from the use of tree terminations 38 is substantially identical to the radiation pattern 60 depicted in FIG. 2. This is as it should be since tree terminations 38 are used merely to increase the effective electrical length of radiating element 30. Surprisingly, however, the radiation pattern 160 illustrated in FIG. 7 resulting from using several radiating elements 130 to form an array 120 is also substantially the same as the radiation pattern 60 of a single radiating element 30, as shown in FIG. 2. This result is one of the chief advantages of using an underground antenna array 120 in accordance with the present invention, since gain may be increased substantially without having any significant effect on the radiation pattern. This is a sharp contrast to conventional aboveground antenna arrays whose radiation pattern often differs significantly from that of a single radiating element.

In addition to the ground wave radiation pattern which is produced by antenna system 20 (FIGS. 2 and 4) and antenna array 120 (FIG. 7), there is also a sky wave radiation pattern. The sky wave elevation radiation pattern in line with the elements is depicted in FIGS. 10, 11, and 12. The exact form of the sky wave radiation pattern depends upon the electrical length of the radiating elements 30 or 130. For radiating elements having an effective electrical length which is approximately one-half of the wavelength in the earth of the electromagnetic signals, the sky wave radiation pattern is as depicted at 57 in FIG. 10. As the effective electrical length of radiating elements 30 or 130 approaches one wavelength, the sky wave radiation pattern approaches that illustrated at 58 in FIG. 11. For effective electrical lengths which exceed one wavelength, the sky wave radiation pattern approaches that shown at 59 of FIG. 12. As the frequency increases additional nulls are formed but the depth of the nulls tends to be small.

At low elevation angles the radiation polarization is vertical and the sky wave azimuth pattern is similar to the ground wave azimuth pattern. As the elevation increases the nulls at right angles to the elements fill in and both vertical and horizontal polarization components exist.

As noted above, radiating elements 30 and 130 are illustrated herein as being substantially symmetrical linear electric dipoles. Accordingly, the various radiation patterns described above are also illustrated as being substantially symmetrical. It should be noted, however, that an asymmetrical radiation pattern will result if arms 32 and 132 of radiating elements 30 and 130, respectively, are unequal in length. In such case, a greater signal strength will be produced in the direction of the longer arms 32 and 132, while a substantially weaker signal strength will be produced in the direction of the shorter arms 32 and 132. Thus, by making radiating elements 30 and 130 asymmetrical, the signal strength of antenna systems 20 and 120 can be concentrated in a particular direction so as to yield a substantially unidirectional radiation pattern.

It will be appreciated by those skilled in the art that, since radiating elements 30 and 130 are substantially parallel to the earth's surface 42, a horizontal component of the electric field must be present in order for the radiation to be received. However, electromagnetic signals which are propagated along the earth's surface (i.e., ground waves) are typically vertically polarized and have virtually no horizontal component. Since signals may, nevertheless, be received by antenna systems 20 and antenna array 120 in that radiating elements 30 and 130 cooperate with the earth 40 so as to tilt the electromagnetic signals "downward" somewhat, thereby inducing a horizontal electric field component in the electromagnetic signals. This horizontal field component then excites an appropriate current in radiating elements 30 and 130, as required for signal reception. A similar action takes place for transmission.

5. Summary

From the foregoing, it will be appreciated that the present invention provides a communication system which permits high quality communication, while having sufficient "hardness" to survive all but a direct hit by a nuclear weapon. To this end, the guided wave antenna system of the present invention is configured so as to provide for high quality, long distance atmospheric propagation of electromagnetic signals between underground transmitting and receiving antennas.

Significantly, by forming an underground array of radiating elements and by constructing such radiating elements so as to have a sufficient effective electrical length, the present invention provides a communication system having underground antennas which is capable of transmitting and receiving electromagnetic signals over a wide frequency band without tuning and at data rates which are comparable to communication systems having conventional aboveground antennas. In addition, by providing the radiating elements with appropriate tree terminations, it is possible to significantly reduce the physical antenna conductor length which is required in order to transmit and receive electromagnetic signals at various frequencies. Further, portions of each underground radiating element may be surrounded by a low loss dielectric substance, thereby providing an efficient communication system in typically conductive mediums.

It will also be appreciated that the guided wave antenna system of the present invention is relatively inexpensive to construct, install, and maintain. Thus, the present invention provides a long distance communication system having an underground guided wave antenna which is configured so as to make it economically feasible to construct backup antenna systems in order to achieve an acceptable level of "hardness." Also, the present invention advantageously provides a high power, long distance antenna system which does not degrade the surrounding environment and which is easily camouflaged.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A system for an underground guided wave antenna for transmitting and receiving electromagnetic signals, said system comprising:

a transmitter/receiver apparatus;

a radiating element buried in the earth and comprising means for enhancing the capacitive coupling between said radiating element and the earth, and means for establishing an effective electrical length for said radiating element equal to at least one-third wavelength of said electromagnetic signals when propagated through earth; and means for electrically connecting said radiating element to said transmitter/receiver apparatus.

2. A system for an underground guided wave antenna as defined in claim 1 wherein said radiating element is buried substantially parallel to the earth's surface.

3. A system for an underground guided wave antenna as defined in claim 1 wherein said radiating element is buried at a depth of approximately one meter below the earth's surface.

4. A system for an underground guided wave antenna as defined in claim 1 wherein said radiating element comprises a conductor and means for insulating said conductor along the entire length thereof.

5. A system for an underground guided wave antenna as defined in claim 4 wherein said means for insulating said radiating element comprises a thickness that is at least two times the cross-sectional thickness of said conductor.

6. A system for an underground guided wave antenna as defined in claim 1 wherein said radiating element comprises two substantially colinear conductive arms and means for electrically coupling said arms to each other at one of the ends thereof.

7. A system for an underground guided wave antenna as defined in claim 6 wherein said arms are substantially equal in length.

8. A system for an underground guided wave antenna as defined in claim 6 wherein said means for connecting said radiating element to said transmitter/receiver apparatus comprises a coaxial cable, and wherein said means for electrically coupling said arms comprises a balance-to-unbalance transformer for connecting said conductive arms to said coaxial cable.

9. A system for an underground guided wave antenna as defined in claim 1 wherein said means for electrically connecting said radiating element to said transmitter/-receiver apparatus comprises a parallel balanced transmission line.

10. A system for an underground guided wave antenna as defined in claim 1 further comprising a plurality of radiating elements which are substantially identical and which are buried substantially parallel to one another.

11. A system for an underground guided wave antenna as defined in claim 10 wherein said radiating elements are spaced in parallel one from the other along their length at a distance of at least one-half skin depth.

12. A system for an underground guided wave antenna as defined in claim 1 wherein said means for establishing said effective electrical length of said radiating element comprises a conductive tree termination formed on at least one end of said radiating element.

13. A system for an underground guided wave antenna as defined in claim 1 further comprising a substantially horizontal trench dug in said earth and corresponding in length to the length of said radiating element, and wherein said radiating element is buried in said trench.

14. A system for an underground guided wave antenna as defined in claim 13 further comprising a water-resistant liner positioned in said trench for maintaining the earth surrounding said radiating element in a relatively dry condition.

15. A system for an underground guided wave antenna as defined in claim 13 further comprising a low loss dielectric fill material in which said radiating element is buried within said trench along at least a substantial portion of the length of said radiating element.

16. A system for an underground guided wave antenna as defined in claim 15 wherein said low loss dielectric fill material comprises a conductivity of approximately $1\times10^{-3}$ mho per meter and a relative dielectric constant not greater than approximately 3.

17. A system for an underground guided wave antenna as defined in claim 13 further comprising means for draining said trench so as to prevent water from collecting near said radiating element.

18. A system for an underground guided wave antenna as defined in claim 15 wherein said trench comprises two levels such that said low loss dielectric fill material essentially surrounds all but the end portions of said radiating element so that said end portions may be capacitively coupled to said earth.

19. A system for an underground guided wave antenna as defined in claim 13 further comprising a water-resistant cover for covering the top of said trench.

20. A system for an underground guided wave antenna for transmitting and receiving electromagnetic signals, said system comprising:

a transmitter/receiver apparatus;

a plurality of radiating elements buried in the earth and spaced in parallel along their length at a distance of approximately one-half skin depth or more, each said radiating element comprising means for enhancing the capacitive coupling between said radiating element and the earth; and means for electrically connecting said radiating elements to said transmitter/receiver apparatus.

21. A system for an underground guided wave antenna as defined in claim 20 wherein said radiating elements are buried substantially parallel to the earth's surface.

22. A system for an underground guided wave antenna as defined in claim 20 wherein said radiating elements are buried at a depth of approximately one meter below the earth's surface.

23. A system for an underground guided wave antenna as defined in claim 20 wherein each said radiating element comprises a conductor and means for insulating said conductor along the entire length thereof.

24. A system for an underground guided wave antenna as defined in claim 20 wherein said means for insulating each said radiating element comprises a sheath surrounding said conductor, said sheath having a thickness that is at least two times the cross-sectional thickness of said conductor.

25. A system for an underground guided wave antenna as defined in claim 20 wherein each radiating element comprises two substantially colinear conductive arms and means for electrically coupling said arms to each other at one of the ends thereof.

26. A system for an underground guided wave antenna as defined in claim 25 wherein said arms are substantially equal in length.

27. A system for an underground guided wave antenna as defined in claim 20 wherein said means for electrically connecting said radiating elements to said transmitter/receiver apparatus comprises:

a power splitter connected through a transmission line to said transmitter/receiver apparatus; and a balance-to-unbalance transformer connected at each said radiating element to said power splitter through a cable such that each said radiating element will be powered equally and in phase.

28. A system for an underground guided wave antenna as defined in claim 20 wherein each said radiating element comprises means for establishing an effective electrical length of said radiating elements equal to one-half wavelength of said electromagnetic signals when propagated through earth.

29. A system for an underground guided wave antenna as defined in claim 28 wherein said means for establishing said effective electrical length comprises a conductive tree termination formed on at least one end of each said radiating element.

30. A system for an underground guided wave antenna as defined in claim 20 further comprising a trench dug in said earth for each said radiating element, each trench corresponding in length to the length of said radiating element, and wherein each said radiating element is buried in one of said trenches.

31. A system for an underground guided wave antenna as defined in claim 30 further comprising a water-resistant liner positioned in each said trench for maintaining the earth surrounding the radiating element in each said trench in a relatively dry condition.

32. A system for an underground guided wave antenna as defined in claim 30 further comprising a low loss dielectric fill material placed in each said trench so as to bury each said radiating element within said low loss dielectric fill material.

33. A system for an underground guided wave antenna as defined in claim 32 wherein said low loss dielectric fill material comprises a conductivity of approximately $1\times10^{-3}$ mho per meter and a relative dielectric constant not greater than approximately 3.

34. A system for an underground guided wave antenna as defined in claim 30 further comprising means for draining each said trench so as to prevent water from collecting near each said radiating element.

35. A system for an underground guided wave antenna as defined in claim 32 wherein each said trench comprises two levels such that said low loss dielectric fill material essentially surrounds all but the end portions of each said radiating element so that said end portions may be capacitively coupled to said earth.

36. A system for an underground guided wave antenna as defined in claim 30 further comprising a water-resistant cover for covering the top of each said trench.

37. A system for an underground guided wave antenna for transmitting and receiving electromagnetic signals, said system comprising:

a transmitter/receiver apparatus;

a radiating element buried in the earth at a depth of not more than one skin depth, said radiating element comprising means for establishing an effective electrical length for said radiating element equal to at least one-third wavelength of said electromagnetic signals when propagated through earth, and said radiating element further comprising means for insulating said radiating element along substantially the entire length thereof;

means for surrounding all but the outer end portions of said radiating element with a low loss dielectric material; and means for electrically connecting said radiating element to said transmitter/receiver apparatus.

38. A system as defined in claim 37 wherein said radiating element is buried substantially parallel to the earth's surface.

39. A system as defined in claim 37 wherein said radiating element comprises two substantially colinear conductive arms and means for electrically coupling said arms to each other at one of the ends thereof.

40. A system as defined in claim 39 wherein said radiating element further comprises a sheath surrounding each said conductive arm, said sheath having a thickness that is at least two times the cross-sectional thickness of said conductive arm.

41. A system as defined in claim 39 wherein each said conductive arm is substantially equal in length.

42. A system as defined in claim 37 wherein said means for establishing said effective electrical length of said radiating element comprises a conductive tree termination formed on at least one end of said radiating element.

43. A system as defined in claim 37 further comprising a plurality of radiating elements which are substantially identical and which are buried substantially parallel to one another.

44. A system as defined in claim 43 wherein said radiating elements are spaced in parallel one from the other along their length at a distance of at least one-half skin depth.

45. A system as defined in claim 43 wherein each said radiating element comprises two substantially colinear conductive arms and means for electrically coupling said arms to each other at one of the ends thereof, and wherein said conductive arms are buried at a depth of no more than one skin depth below the earth's surface, and each said conductive arm further comprising a sheath of insulating material surrounding said conductive arm and having a thickness that is at least two times the cross-sectional thickness of said conductive arm.

46. A system as defined in claim 45 wherein each said radiating element comprises means for establishing an effective electrical length for said radiating element equal to at least one-third wavelength of said electromagnetic signals when propagated through earth.

47. A system as defined in claim 46 wherein said means for establishing an effective electrical length for each said radiating element comprises a conductive tree termination formed on at least one end of each said radiating element.

48. A system as defined in claim 37 further comprising a trench dug in said earth and corresponding in length to the length of said radiating element, and wherein said radiating element is buried in said trench.

49. A system as defined in claim 47 further comprising a water-resistant liner positioned in said trench for maintaining the earth surrounding said radiating element in a relatively dry condition.

50. A system as defined in claim 47 wherein said low loss dielectric fill material comprises a conductivity of approximately $1\times10^{-3}$ mho per meter and relative dielectric constant not greater than approximately 3.

51. A system as defined in claim 47 further comprising means for draining said trench so as to prevent water from collecting near said radiating element.

52. A system as defined in claim 47 wherein said trench comprises two levels such that said low loss dielectric fill material essentially surrounds all but the end portions of said radiating element so that said end portions may be capacitively coupled to said earth.

53. A system as defined in claim 47 further comprising a water-resistant cover for covering the top of said trench.

54. A system for an underground guided wave antenna for transmitting and receiving electromagnetic signals, said system comprising:

a transmitter/receiver apparatus;

a plurality of radiating elements buried substantially parallel to the surface of the earth at a depth of not greater than one skin depth beneath said surface, and spaced in parallel one from the other along their length at a distance of approximately one-half skin depth, each said radiating element comprising a pair of conductive arms and an insulative sheath covering each said conductive arm, said insulative sheath having a thickness of approximately twice the cross-sectional thickness of said conductive arms, each said pair of conductive arms comprising means for electrically coupling said pair of conductive arms at one of the ends thereof and said conductive arms further comprising conductive tree terminations formed at the other ends thereof for establishing an effective electrical length for each said radiating element equal to at least one-third wavelength of said electromagnetic signals when propagated through earth; and means for electrically connecting each said radiating element to said transmitter/receiver apparatus.

55. A system as defined in claim 54 wherein each said conductive arm is substantially equal in length.

56. A system as defined in claim 54 wherein said means for electrically connecting said radiating elements to said transmitter/receiver apparatus comprises:

a power splitter connected through a transmission line to said transmitter/receiver apparatus; and a balance-to-unbalance transformer connected at each said radiating element to said power splitter through a cable such that each said radiating element will be powered equally and in phase.

57. A system as defined in claim 54 further comprising a trench dug in said earth for each said radiating element, each trench corresponding in length to the length of one of said radiating elements and wherein each said radiating element is buried in one of said trenches.

58. A system as defined in claim 57 further comprising a water-resistant liner positioned in each said trench for maintaining the earth surrounding the radiating element in each said trench in a relatively dry condition.

59. A system as defined in claim 57 further comprising a low loss dielectric fill material placed in each said trench so as to bury each said radiating element within said low loss dielectric fill material.

60. A system as defined in claim 57 further comprising means for draining each said trench so as to prevent water from collecting near said radiating elements.

61. A system as defined in claim 57 wherein each said trench comprises two levels such that said low loss dielectric fill material essentially surrounds all but the end portions of said radiating elements where said tree terminations are formed so that said end portions may be capacitively coupled to said earth.

62. A system as defined in claim 57 further comprising a water-resistant cover for covering the top of each said trench.

63. A method for constructing an underground guided wave antenna system for transmitting and receiving electromagnetic signals, the method comprising the steps of:

burying a radiating element beneath the surface of the earth;

surrounding a portion of said radiating element with a low loss dielectric fill material;

establishing an effective electrical length for said radiating element equal to at least one-third wavelength of said electromagnetic signals when propagated through earth; and electrically connecting said radiating element to a transmitter/receiver apparatus.

64. A method as defined in claim 63 wherein said radiating element is buried at a depth of not more than one skin depth.

65. A method as defined in claim 63 wherein said radiating element comprises a pair of conductive arms electrically coupled at one end of each arm, and wherein said step of establishing said effective electrical length comprises attaching conductive tree terminations to the other end of said conductive arms.

66. A method as defined in claim 65 further comprising the step of insulating each said conductive arm along essentially its entire length.

67. A method as defined in claim 66 wherein said insulating step comprises covering each said conductive arm with an insulative sheath having a thickness approximately twice the cross-sectional thickness of said conductive arms.

68. A method as defined in claim 63 wherein said surrounding step comprises:

digging a trench up to a first level with a low loss dielectric fill material;

placing said radiating element in said trench such that all but the end portions of said radiating element are resting on said fill material; and covering said radiating element with said fill material up to the second level of said trench.

69. A method as defined in claim 68 wherein said fill material comprises crushed rock having a conductivity of approximately $1\times10^{-3}$ mho per meter and a relative dielectric constant not greater than approximately 3.

70. A method as defined in claim 68 further comprising the step of draining said trench to prevent water from accumulating near said buried radiating element.

71. A method as defined in claim 68 further comprising the step of lining said trench with a water-resistant liner.

72. A method as defined in claim 68 further comprising the step of covering said trench with a water-resistant cover.

73. A method as defined in claim 63 wherein said burying step comprises burying a plurality of radiating elements in a substantially horizontal plane at a depth of not more than one skin depth.

74. A method as defined in claim 73 further comprising the step of spacing said radiating elements one from another such that said radiating elements are spaced in parallel at a distance of at least one-half skin depth.

75. A method for construcing an underground guided wave antenna system for sending and receiving electromagnetic signals, the method comprising the steps of:

burying a radiating element beneath and essentially parallel to the surface of the earth at a depth of not more than one skin depth;

providing an effective electrical length for said radiating element equal to at least one-half wavelength of said electromagnetic signals when propagated through earth;

insulating said radiating element along essentially the entire length of said element;

surrounding all but essentially the outer end portions of said radiating element with a low loss dielectric material; and electrically connecting said radiating element to a transmitter/receiver apparatus.

76. A method as defined in claim 75 wherein said burying step comprises burying a plurality of radiating elements substantially parallel along their length and at spaced intervals of at least one-half skin depth.

77. A system for an underground guided wave antenna for transmitting and receiving electromagnetic signals, said system comprising:

a transmitter/receiver apparatus;

a radiating element insulated along its entire length and buried in the earth and comprising means for establishing an effective electrical length for said radiating element equal to at least one-third wavelength of said electromagnetic signals when propagated through earth;

low loss dielectric fill material essentially surrounding all but the end portions of the buried length of said radiating element; and means for electrically connecting said radiating element to said transmitter/receiver apparatus.

78. A system for an underground guided wave antenna for transmitting and receiving electromagnetic signals, said system comprising:

a transmitter/receiver apparatus;

a plurality of radiating elements insulated along their entire length and buried in the earth and spaced in parallel along their length at a distance of approximately one-half skin depth or more;

low loss dielectric fill material essentially surrounding all but the end portions of the buried length of said radiating element; and means for electrically connecting said radiating elements to said transmitter/receiver apparatus.

* * * * *

UNITED STATES PATENT AND TRADEMARK OFFICE

CERTIFICATE OF CORRECTION

PATENT NO. : 4,839,661

DATED : June 13, 1989

INVENTOR(S) : Ferril A. Losee

It is certified that error appears in the above-identified patent and that said Letters Patent is hereby corrected as shown below:

Column 5, line 8, "eart" should be --earth--
Column 9, lines 12-13, "signals" should be --signal--
Column 18, line 57, The sentence should not be disjoined, but should continue on the same line.
Column 21, line 10, "47" should be --48--
Column 21, line 18, "47" should be --48--

Signed and Sealed this

Ninth Day of October, 1990

*Attest:*

*Attesting Officer*

HARRY F. MANBECK, JR.

*Commissioner of Patents and Trademarks*